US007586394B2

(12) United States Patent
Spitsberg et al.

(10) Patent No.: US 7,586,394 B2
(45) Date of Patent: Sep. 8, 2009

(54) ELECTRICAL SWITCHING APPARATUS, AND TRIP ACTUATOR RESET ASSEMBLY AND LEVER ARM ASSEMBLY THEREFOR

(75) Inventors: Yuri Spitsberg, Pittsburgh, PA (US); Nathan J. Weister, Darlington, PA (US)

(73) Assignee: Eaton Corporation, Cleveland, OH (US)

( * ) Notice: Subject to any disclaimer, the term of this patent is extended or adjusted under 35 U.S.C. 154(b) by 264 days.

(21) Appl. No.: 11/775,337

(22) Filed: Jul. 10, 2007

(65) Prior Publication Data

US 2009/0015359 A1 Jan. 15, 2009

(51) Int. Cl.
*H01H 9/20* (2006.01)

(52) U.S. Cl. ..... 335/166; 335/26; 335/33; 335/116; 335/150; 200/38 F

(58) Field of Classification Search ..... 335/26, 335/33, 116, 150, 166; 200/38 F
See application file for complete search history.

(56) References Cited

U.S. PATENT DOCUMENTS 4,001,742 A * 1/1977 Jencks et al. ..... 335/173
6,921,873 B2 7/2005 Puskar et al.
2008/0245648 A1 * 10/2008 Weister et al. ..... 200/556
2008/0245649 A1 * 10/2008 Spitsberg et al. ..... 200/556
2008/0246565 A1 * 10/2008 Spitsberg et al. ..... 335/166
2008/0257702 A1 * 10/2008 Weister et al. ..... 200/400
2008/0302640 A1 * 12/2008 Weister et al. ..... 200/43.16
2008/0302645 A1 * 12/2008 Rakus et al. ..... 200/337

* cited by examiner

*Primary Examiner*—Lincoln Donovan
*Assistant Examiner*—Mohamad A Musleh
(74) *Attorney, Agent, or Firm*—Martin J. Moran

(57) ABSTRACT

A lever arm assembly is provided for a circuit breaker trip actuator reset assembly including a cradle assembly pivotably coupled to the circuit breaker pole shaft, a reset lever pivotably coupled to the circuit breaker housing, and a trip actuator including an actuating element, which moves the reset lever in response to a trip condition. The lever arm assembly includes at least one linking element including a first end pivotably coupled to the cradle assembly, a second end, a pivot, and a deflection assembly having a deflection member. When the cradle assembly moves from a first position toward a second position, it moves the linking element, thereby moving the deflection member into engagement with the reset lever. This pivots the reset lever to reset the trip actuator. After the trip actuator has been reset, the deflection assembly is deflectable to accommodate excess motion of the cradle assembly.

23 Claims, 5 Drawing Sheets

ELECTRICAL SWITCHING APPARATUS, AND TRIP ACTUATOR RESET ASSEMBLY AND LEVER ARM ASSEMBLY THEREFOR

CROSS-REFERENCE TO RELATED APPLICATIONS

This application is related to commonly assigned, co-pending:

U.S. patent application Ser. No. 11/696,810, filed Apr. 5, 2007, entitled "ELECTRICAL SWITCHING APPARATUS AND TRIP ACTUATOR ASSEMBLY THEREFOR";

U.S. patent application Ser. No. 11/696,815, filed Apr. 5, 2007, entitled "ELECTRICAL SWITCHING APPARATUS, AND TRIP ACTUATOR ASSEMBLY AND RESET ASSEMBLY THEREFOR"; and U.S. patent application Ser. No. 11/696,812, filed Apr. 5, 2007, entitled "ELECTRICAL SWITCHING APPARATUS AND TRIP ACTUATOR RESET ASSEMBLY THEREFOR," which are hereby incorporated herein by reference.

BACKGROUND OF THE INVENTION

1. Field of the Invention

The invention relates generally to electrical switching apparatus and, more particularly, to trip actuator reset assemblies for electrical switching apparatus, such as circuit breakers. The invention also relates to lever arm assemblies for circuit breaker trip actuator reset assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Among other components, the operating mechanisms of some low-voltage circuit breakers, for example, typically include a pole shaft and a trip actuator assembly. The pole shaft pivots during opening and closing operations of the circuit breaker, which operations respectively correspond to electrical contact assemblies being opened (e.g., contacts separated) and closed (e.g., contacts electrically connected). The trip actuator assembly typically includes a trip bar, a trip actuator such as, for example, a solenoid, and a cradle assembly. The cradle assembly is coupled to and is cooperable with the pole shaft. The trip actuator (e.g., solenoid) has a spring, a coil which is energized by the trip unit in response to the electrical fault condition, and an actuating element such as, for example, a plunger. Normally (e.g., in the absence of the electrical fault condition), the plunger is latched (e.g., by a magnet) in a retracted position. When the coil is energized, in response to the electrical fault condition, the magnetic force that holds the plunger in the retracted position is overcome and the spring biases the plunger to an extended position and maintains it there. When the plunger extends, it causes the trip bar to pivot and trip open the electrical contact assemblies.

Subsequently, both the electrical contact assemblies and the trip actuator must be reset. The trip actuator assembly operates in conjunction with the pole shaft to perform the resetting operation. Specifically, when the circuit breaker operating mechanism is reset, the pole shaft pivots, thereby moving the cradle assembly. The cradle assembly then pivots a reset arm which, in turn, depresses the actuating element (e.g., plunger) and resets the trip actuator (e.g., solenoid). The travel and actuating force of the plunger are relatively limited. Therefore, any misalignment between circuit breaker components can adversely affect the reset operation of the trip actuator assembly. For example, because the pole shaft, the cradle assembly, and the reset lever are coupled together, dimensional variations and/or assembly errors can result in imprecise interaction among these components. By way of example, the pole shaft and the cradle assembly may, for example, move in a manner which tends to over-rotate the reset lever of the trip actuator reset assembly. More specifically, over-rotation occurs when the reset lever has completely depressed the plunger, thus resetting the trip actuator, but the pole shaft and/or the cradle assembly continue to move causing the reset lever to continue to apply pressure to the plunger.

There is, therefore, room for improvement in electrical switching apparatus, such as circuit breakers, and in trip actuator reset assemblies therefor.

SUMMARY OF THE INVENTION

These needs and others are met by embodiments of the invention, which are directed to a lever arm assembly for trip actuator reset assemblies of electrical switching apparatus such as, for example, circuit breakers, wherein the lever arm assembly can accommodate dimensional and/or assembly imperfections and conditions (e.g., over-rotation of the pole shaft, cradle assembly and/or reset lever) caused thereby, in order to avoid damage to the circuit breaker and to accurately and consistently reset the trip actuator.

As one aspect of the invention, a lever arm assembly is provided for a trip actuator reset assembly of an electrical switching apparatus including a housing, separable contacts enclosed by the housing, and an operating mechanism structured to open and close the separable contacts. The operating mechanism includes a pole shaft. The trip actuator reset assembly includes a cradle assembly pivotably coupled to the pole shaft, a reset lever pivotably coupled to the housing, and a trip actuator including an actuating element. The cradle assembly is movable among a first position corresponding to the separable contacts being closed, and a second position corresponding to the separable contacts being open. The actuating element is structured to move the reset lever in response to a trip condition. The lever arm assembly comprises: at least one linking element including a first end structured to be pivotably coupled to the cradle assembly, a second end disposed opposite and distal from the first end, and a pivot structured to pivotably couple such linking element to the housing; and a deflection assembly comprising a deflection member disposed on a corresponding one of the at least one linking element and being structured to move the reset lever. After the trip condition, the actuating element of the trip actuator is structured to be reset. When the cradle assembly moves from the first position toward the second position, the cradle assembly moves the corresponding one of the at least one linking element, thereby moving the deflection member into engagement with the reset lever, in order to pivot the reset lever. When the deflection member pivots the reset lever, the reset lever moves the actuating element of the trip actuator, thereby resetting the trip actuator, and after the trip actuator has been reset, if the cradle assembly continues to move beyond the second position, then the deflection assembly deflects to accommodate any additional motion of the cradle assembly.

The corresponding one of the at least one linking element may comprise an elongated arm including a first end, a second end, a first edge, a second edge disposed opposite the first edge, a pivot disposed at or about the second end, and at least one recess disposed on the first edge proximate the pivot. The deflection assembly may be coupled to the first edge at or about the at least one recess. The deflection assembly may further comprise a bias element substantially disposed within a corresponding one of the at least one recess, wherein the bias element is structured to bias the deflection member toward engagement with the reset lever. The at least one recess may be a first recess and a second recess disposed on the first edge of the elongated arm proximate the first recess. The deflection member may be a generally planar member having a first side facing the first edge of the elongated arm, a second side disposed opposite the first side, a first end, a second end disposed opposite the first end of the generally planar member, and a tab extending outwardly from the first side of the generally planar member at or about the first end of the generally planar member. The second end of the generally planar member may be structured to cooperate with the pivot, and the tab may movably engage the first edge of the elongated arm at or about the second recess.

The pivot may comprise a generally circular portion disposed at or about the second end of the elongated arm. The generally circular portion may include a hole. A pin member may extend through the hole and be structured to be pivotably coupled to the housing of the electrical switching apparatus. A protrusion may extend outwardly from the generally circular portion, wherein the protrusion is generally parallel with respect to the first edge of the elongated arm and is spaced apart from the first edge of the elongated arm. The second end of the generally planar member may be disposed between the protrusion and the first edge of the elongated arm.

The cradle assembly may include a first end pivotably coupled to the pole shaft, a second end disposed opposite and distal from the first end of the cradle assembly, and at least one side member extending between the first end of the cradle assembly and the second end of the cradle assembly. The at least one linking element may further comprise a connecting link structured to interconnect the elongated arm and the cradle assembly, wherein the connecting link includes a first end structured to be pivotably coupled to a corresponding one of the at least one side member, and a second end pivotably coupled to the first end of the elongated arm.

As another aspect of the invention, a trip actuator reset assembly is provided for an electrical switching apparatus including a housing, separable contacts enclosed by the housing, and an operating mechanism structured to open and close the separable contacts. The operating mechanism includes a pole shaft. The trip actuator reset assembly comprises: a cradle assembly including a first end structured to be pivotably coupled to the pole shaft, a second end disposed opposite and distal from the first end, and at least one side member extending between the first end and the second end, the cradle assembly being movable among a first position corresponding to the separable contacts being closed, and a second position corresponding to the separable contacts being open; a reset lever structured to be pivotably coupled to the housing; a trip actuator including an actuating element which, in response to a trip condition, moves the reset lever; and a lever arm assembly comprising: at least one linking element including a first end pivotably coupled to a corresponding one of the at least one side member of the cradle assembly, a second end disposed opposite and distal from the first end of the at least one linking element, and a pivot structured to pivotably couple the at least one linking element to the housing, and a deflection assembly comprising a deflection member disposed on a corresponding one of the at least one linking element and being cooperable with the reset lever. After the trip condition, the actuating element of the trip actuator must be reset. When the cradle assembly moves from the first position toward the second position, the at least one side member of the cradle assembly moves the corresponding one of the at least one linking element, thereby moving the deflection member into engagement with the reset lever, in order to pivot the reset lever. When the deflection member pivots the reset lever, the reset lever moves the actuating element of the trip actuator, thereby resetting the trip actuator, and after the trip actuator has been reset, if the cradle assembly continues to move beyond the second position, then the deflection assembly deflects to accommodate any additional motion of the cradle assembly.

The corresponding one of the at least one linking element of the lever arm assembly may comprise an elongated arm including a first end, a second end, a first edge, a second edge disposed opposite the first edge, a pivot disposed at or about the second end of the elongated arm, and at least one recess disposed on the first edge proximate the pivot of the elongated arm. The deflection member of the deflection assembly may be coupled to the first edge of the elongated arm at or about the at least one recess. The deflection assembly may further comprise a bias element substantially disposed within a corresponding one of the at least one recess, wherein the bias element biases the deflection member toward engagement with the reset lever.

As another aspect of the invention, an electrical switching apparatus comprises: a housing; separable contacts enclosed by the housing; an operating mechanism structured to open and close the separable contacts, the operating mechanism including a pole shaft; and a trip actuator reset assembly comprising: a cradle assembly including a first end pivotably coupled to the pole shaft, a second end disposed opposite and distal from the first end, and at least one side member extending between the first end and the second end, the cradle assembly being movable among a first position corresponding to the separable contacts being closed, and a second position corresponding to the separable contacts being open, a reset lever pivotably coupled to the housing, a trip actuator including an actuating element which, in response to a trip condition, moves the reset lever, and a lever arm assembly comprising: at least one linking element including a first end pivotably coupled to the corresponding one of the at least one side member of the cradle assembly, a second end disposed opposite and distal from the first end of the at least one linking element, and a pivot pivotably coupling the at least one linking element to the housing, and a deflection assembly comprising a deflection member disposed on a corresponding one of the at least one linking element and being cooperable with the reset lever. After the trip condition, the actuating element of the trip actuator must be reset. When the cradle assembly moves from the first position toward the second position, the corresponding one of the at least one side member of the cradle assembly moves the corresponding one of the at least one linking element, thereby moving the deflection member into engagement with the reset lever, in order to pivot the reset lever. When the deflection member pivots the reset lever, the reset lever moves the actuating element of the trip actuator, thereby resetting the trip actuator, and after the trip actuator has been reset, if the cradle assembly continues to move beyond the second position, then the deflection assembly deflects to accommodate any additional motion of the cradle assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
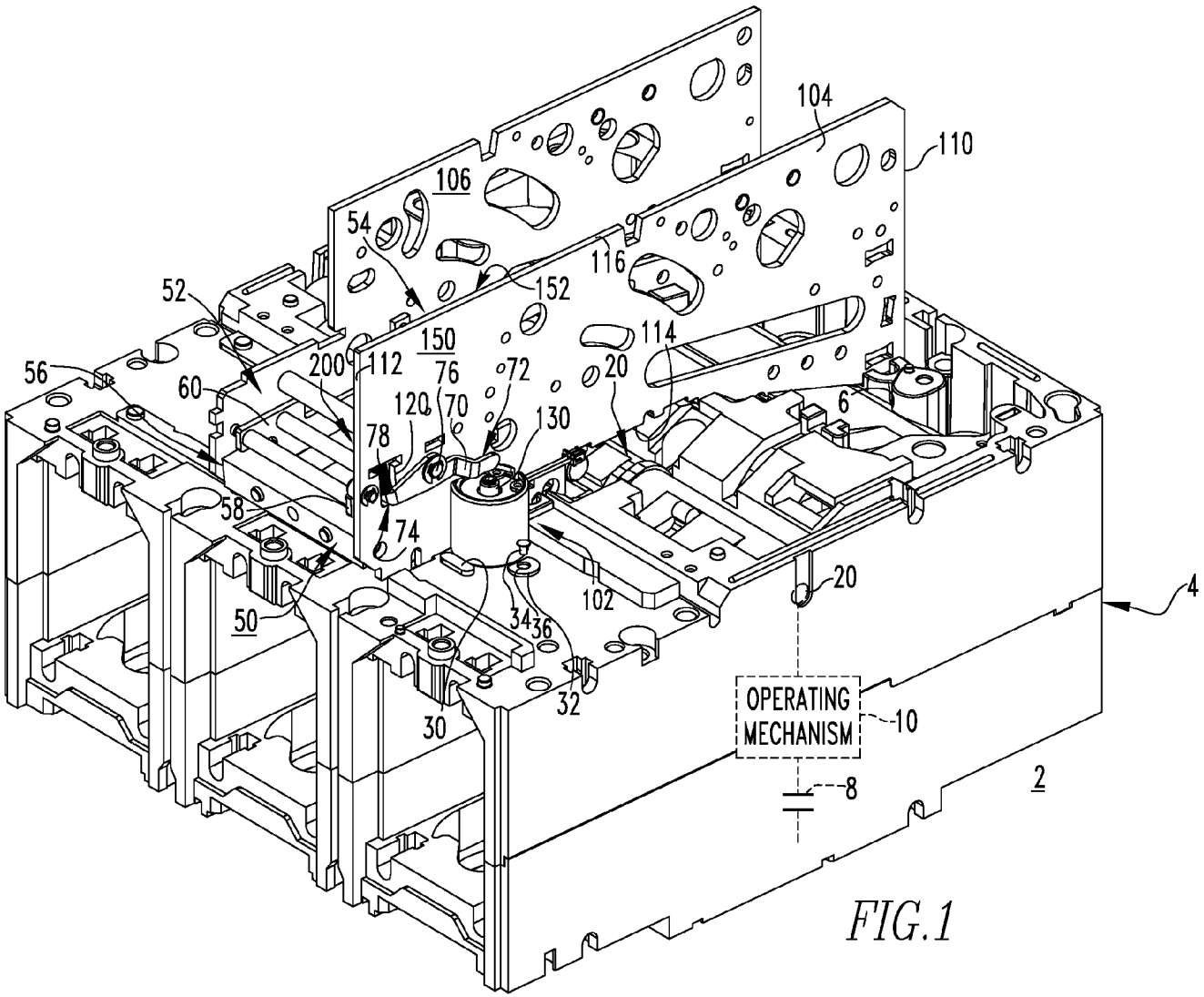
FIG. 1 is an isometric view of one side of a circuit breaker, and a trip actuator reset assembly and lever arm assembly therefor, in accordance with an embodiment of the invention, showing portions of the circuit breaker in block form.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, left, right, top, bottom, upper, lower, front, back, clockwise and counterclockwise and derivatives thereof, relate to the orientation of the elements shown in the drawings and are not limiting upon the claims unless expressly recited therein.

As employed herein, the terms "actuator" and "actuating element" refer to any known or suitable output mechanism (e.g., without limitation, trip actuator; solenoid) for an electrical switching apparatus (e.g., without limitation, circuit switching devices, circuit breakers and other circuit interrupters, such as contactors, motor starters, motor controllers and other load controllers) and/or the element (e.g., without limitation, stem; plunger; lever; paddle; arm) of such mechanism which moves in order to manipulate another component of the electrical switching apparatus.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the term "aperture" refers to any known or suitable passageway into or through a component and expressly includes, but is not limited to, openings, holes, gaps, slots, slits, recesses, and cut-outs.

As employed herein, the term "trip condition" refers to any electrical event that results in the initiation of a circuit breaker operation in which the separable contacts of the circuit breaker are tripped open, and expressly includes, but is not limited to, electrical fault conditions such as, for example, current overloads, short circuits, abnormal voltage and other fault conditions, receipt of an input trip signal, and a trip coil being energized.

As employed herein, the term "linking element" refers to any known or suitable mechanism for connecting one component to another and expressly includes, but is not limited to, rigid links (e.g., without limitation, arms; pins; rods), flexible links (e.g., without limitation, wires; chains; ropes), and resilient links (e.g., without limitation, springs).

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an electrical switching apparatus such as, for example, a low-voltage circuit breaker 2, and a trip actuator reset assembly 50 and a lever arm reset assembly 200 therefor. The circuit breaker 2 includes a housing 4 having a mounting surface 6, separable contacts 8, shown in simplified form in hidden line drawing, enclosed by the housing 4, and an operating mechanism 10, shown in simplified form in hidden line drawing, which is structured to open and close the separable contacts 8. The operating mechanism 10 includes a pivotable pole shaft 20, which is partially shown in FIG. 1 (see also pole shaft 20 of FIGS. 2, 6A and 6B).

The trip actuator reset assembly 50 includes a cradle assembly 52 (best shown in FIG. 2), which has a first end 54 pivotably coupled to the pole shaft 20, a second end 56 disposed opposite and distal from the first end 54, and at least one side member 58,60 (two are shown) extending between the first and second ends 54,56. A reset lever 70 of the trip actuator reset assembly 50 is pivotably coupled to the circuit breaker housing 4, and cooperates with a trip actuator 102 (e.g., without limitation, a solenoid) and, in particular, an actuating element 130 (e.g., without limitation, a plunger) of the trip actuator 102. The actuating element 130 is structured to move the reset lever 70 in response to a trip condition. Interaction of the trip actuator 102 and actuating element 130 thereof with the reset lever 70 will be further appreciated with respect to FIGS. 6A and 6B, which are discussed in greater detail hereinbelow.

The cradle assembly 52 is movable among a first position (FIGS. 1, 2 and 6A), corresponding to the separable contacts 8 being closed, and a second position (FIG. 6B), corresponding to separable contacts 8 being open. Operation of the pole shaft 20 of the circuit breaker operating mechanism 10, the cradle assembly 50, and the trip actuator 102 may be similar, for example, to the operation of the corresponding components described, for example, in commonly assigned U.S. patent application Ser. No. 11/696,810, which has been incorporated herein by reference.

The housing 4 of the example circuit breaker 2 includes the mounting surface 6 and first and second side plates 104,106 extending outwardly therefrom. The first side plate 104 has first and second opposing ends 110, 112, a bottom edge 114, which engages the mounting surface 6 of the circuit breaker housing 4, and a top edge 116. The aforementioned cradle assembly 50 is disposed on the second side 152 of the first side plate 104, between the first and second side plates 104, 106. The example first side plate 104, in combination with a number of protrusions 30,32 and fastener 34, all of which extend outwardly from the mounting surface 6 of the circuit breaker housing 4, secure the trip actuator 102 to the mounting surface 6. More specifically, the fastener 34 engages a hole 36 in protrusion 32, in order to secure the trip actuator 102 in the desired orientation with respect to the first side plate 104. In the example of FIG. 1, the trip actuator 102 is secured to the mounting surface 6 of the circuit breaker housing 4 such that the actuating element 130 of the trip actuator 102 is disposed on the first side 150 of the first side plate 104. It will, however, be appreciated that the trip actuator 102 may be secured in any known or suitable alternative manner and configuration, without departing from the scope of the invention.

Figure 5:
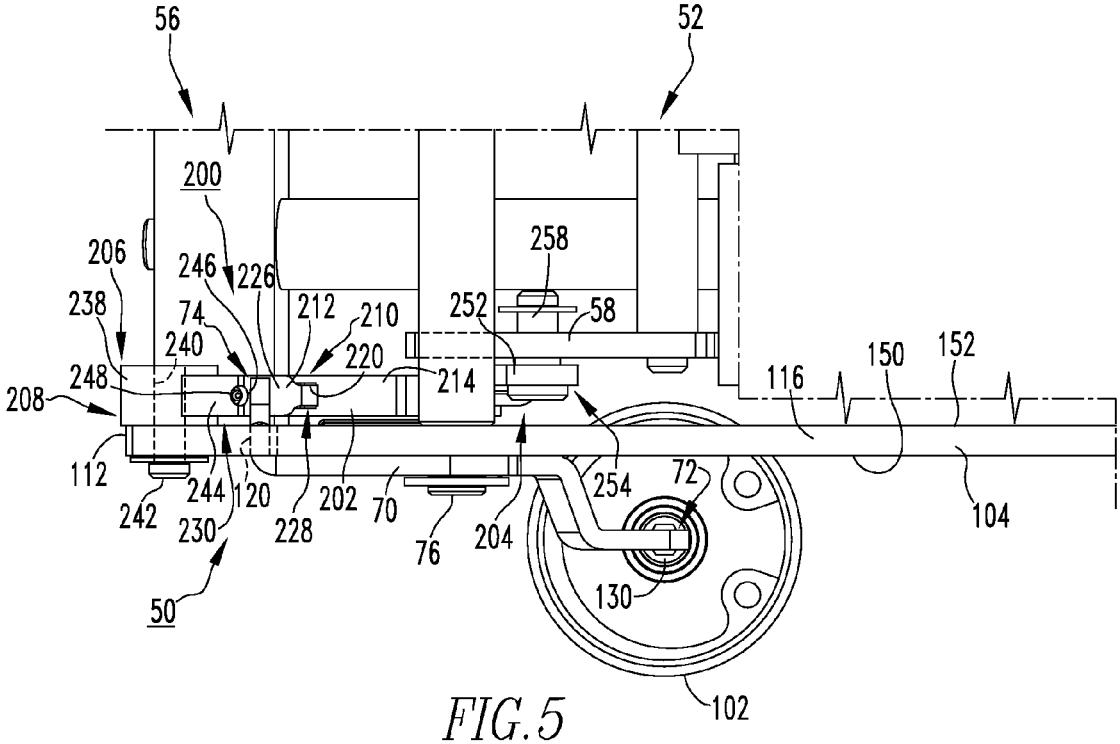
FIG. 5 is a top plan view of a portion of the circuit breaker, and the trip actuator reset assembly and lever arm assembly therefor, of FIG. 1.

As shown in FIGS. 1, 5, 6A and 6B, the reset lever 70 includes a first end 72 overlaying the actuating element 130 of the trip actuator 102, a second end 74 disposed distal from the first end 72, and a pivot 76 pivotably coupling the reset lever 70 to the first side 150 of the first side plate 104. The second end 74 of the reset lever 70 extends from at or about the first side 150 of the first side plate 104, through an opening 120 of the side plate 104, and beyond the second side 152 of the side plate 104, in order to cooperate with the lever arm assembly 200, as best shown in FIG. 5.

Figure 2:
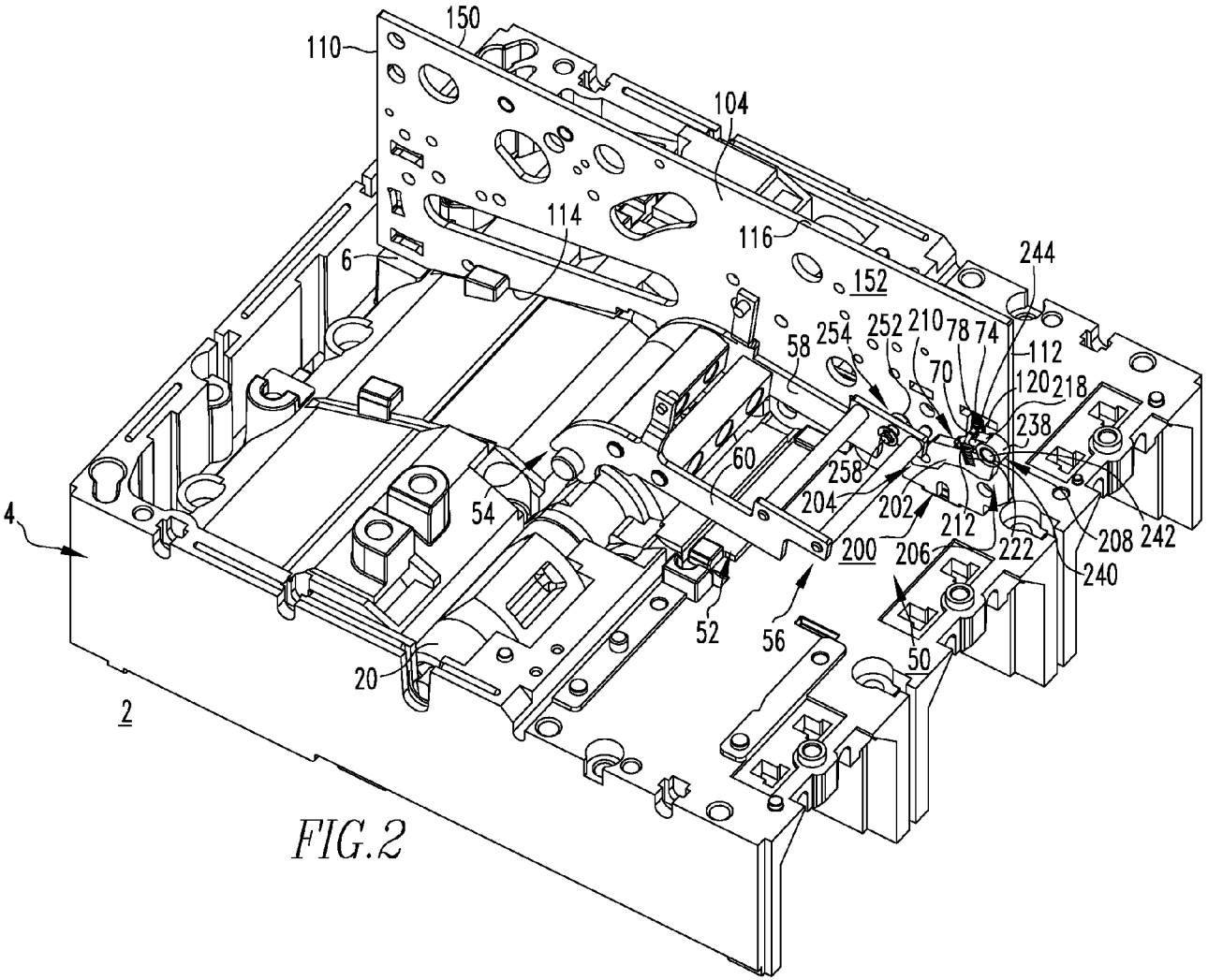
FIG. 2 is an isometric view of the opposite side of the circuit breaker, and trip actuator reset assembly and lever arm assembly therefor of FIG. 1.
Figure 3:
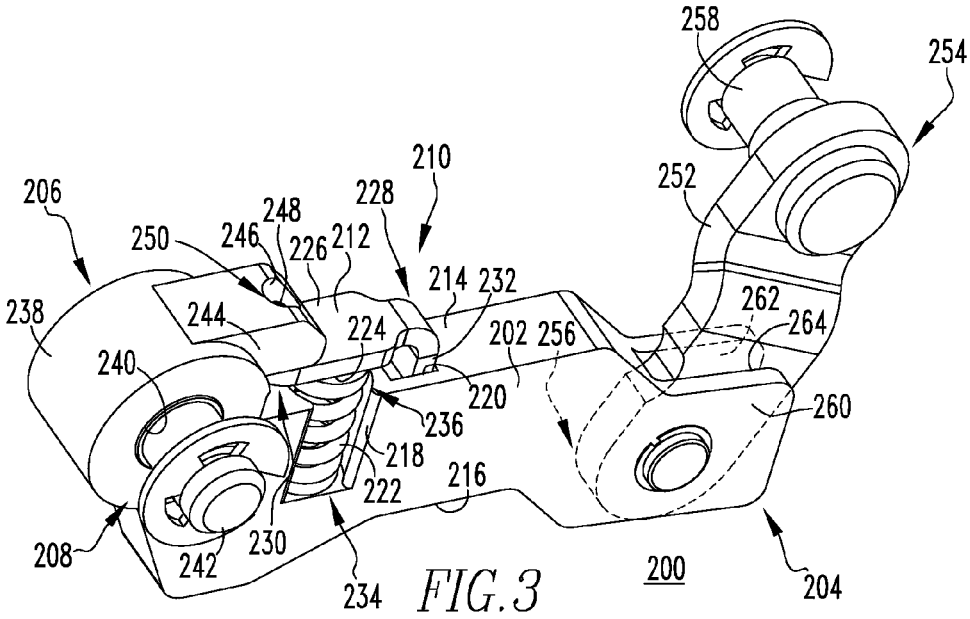
FIG. 3 is an isometric view of the lever arm assembly of FIG. 1.
Figure 4:
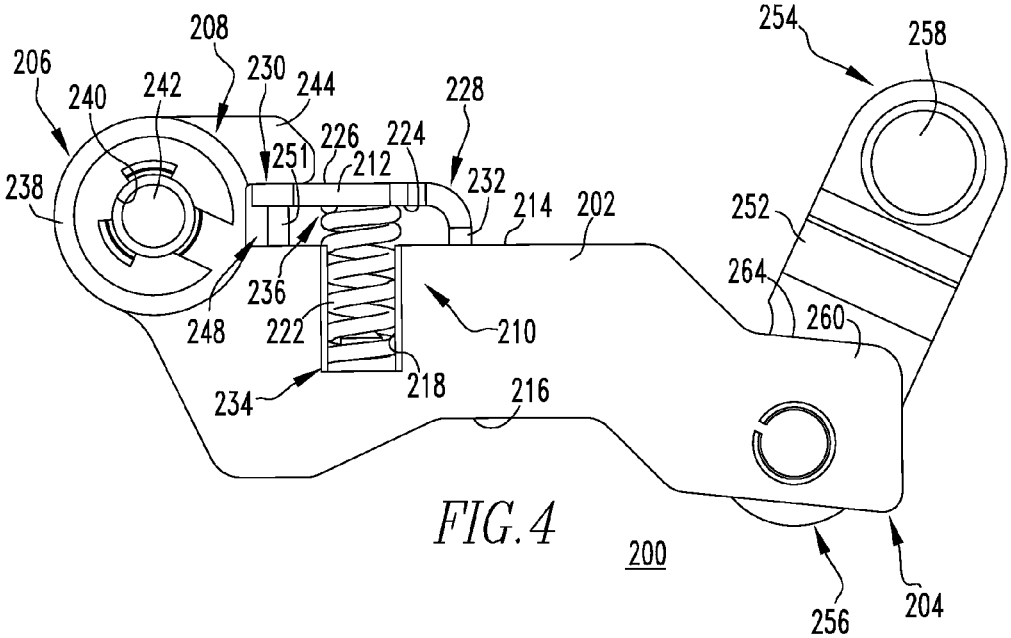
FIG. 4 is a side elevation view of the lever arm assembly of FIG. 1.

Referring to FIGS. 3, 4 and 5, it will be appreciated that the example lever arm assembly 200 includes two linking elements, an elongated arm 202, and a connecting link 252, which interconnects the elongated arm 202 and the cradle assembly 52 (FIGS. 2, 5, 6A and 6B). Specifically, the elongated arm 202 includes a first end 204, a second end 206, first and second opposing edges 214, 216, and a pivot 208 disposed at or about the second end 206. The pivot 208 pivotably couples the elongated arm 202 to the second side 152 of the side plate 104, as best shown in FIG. 2. A deflection assembly 210, which includes a deflection member 212, is movably coupled to the first edge 214 of the elongated arm 202. The second end 74 of the aforementioned reset lever 70 of the trip actuator reset assembly 50 extends through the hole 120 (shown in hidden line drawing in FIG. 5; see also FIGS. 1, 2, 6A and 6B) of the circuit breaker side plate 104, and overlays the deflection member 212 of the correction assembly 210, as shown in FIG. 5. Accordingly, the deflection member 212, which in the example shown and described herein is a generally planar member 212, is structured to move the reset lever 70, thereby moving the actuating element 130 of the trip actuator 102, in order to reset the trip actuator 102 after the trip condition.

Figure 6A:
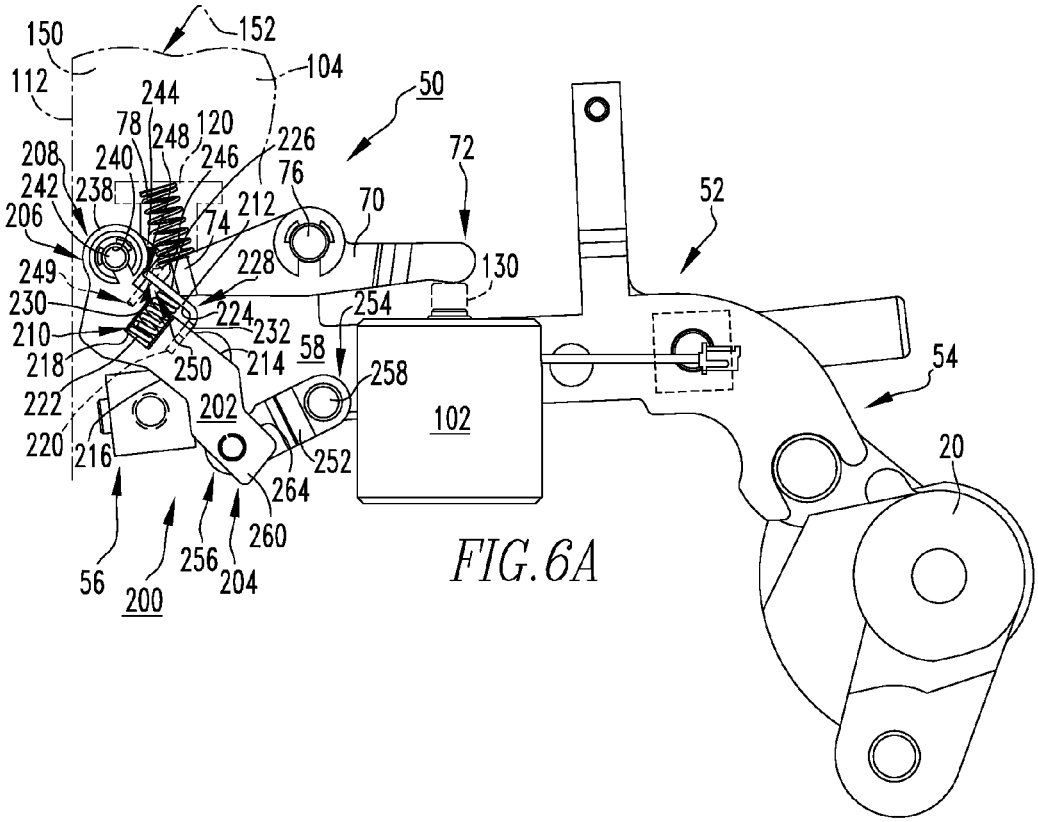
FIG. 6A is a right side elevation view of the trip actuator reset assembly, and pole shaft and cradle assembly of FIG. 1, with each component shown in its respective position corresponding to the circuit breaker being closed.
Figure 6B:
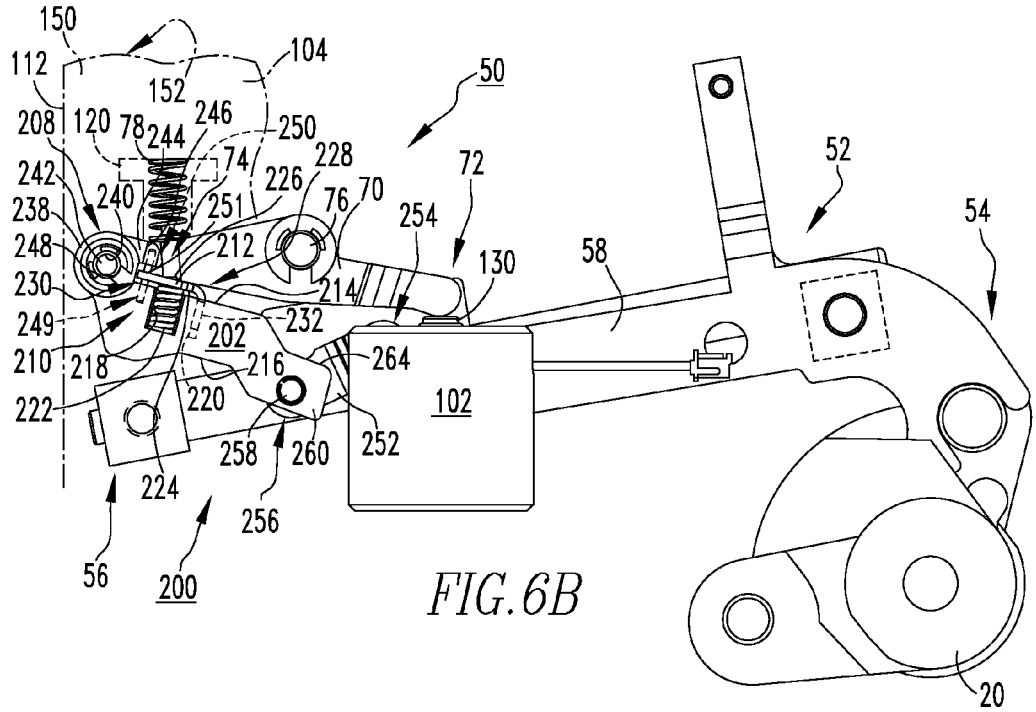
FIG. 6B is a right side elevation view of the trip actuator reset assembly, and pole shaft and cradle assembly of FIG. 6A, modified to show each component in its respective position corresponding to the circuit breaker being open.

Specifically, in response to the trip condition, the actuating element 130 of the trip actuator 102 extends, as shown in phantom line drawing in FIG. 6A, in order to engage and move the first end 72 of the reset lever 70, causing the reset lever 70 to pivot (e.g., counterclockwise with respect to FIG. 6A) about pivot 76. After the trip condition, the actuating element 130 remains extended until it is depressed by the reset lever 70, as shown in FIG. 6B, in order to reset the trip actuator 102. When the cradle assembly 52 is moved toward the second position of FIG. 6B, the deflection member 212 of the deflection assembly 210 of the lever arm assembly 200 engages the second end 74 of the reset lever 70, thereby pivoting the reset lever 70 (e.g., clockwise with respect to FIG. 6B) about pivot 76. As the cradle assembly 52 moves into the second position (FIG. 6B), the reset lever 70 continues to pivot until the first end 72 of the reset lever 70 completely depresses the actuating element 130, thereby resetting the trip actuator 102, as shown in FIG. 6B. After the trip actuator 102 is reset, if the cradle assembly 52 continues to move (e.g., continues to pivot the reset lever 70 clockwise about pivot 76), then the deflection member 212 of the deflection assembly 210 deflects (FIG. 6B) to absorb such movement. In this manner, the lever arm assembly 200 and, in particular, the deflection assembly 210 thereof, among other benefits, accommodate excess motion of the cradle assembly 50 in order to resist damage that could otherwise be caused thereby (e.g., without limitation, damage to the trip actuator 102 and/or actuating element 130 thereof).

Continuing to refer to FIGS. 3 and 4, it will be appreciated that the elongated arm 202 of the example lever arm assembly 200 further includes first and second recesses 218,220 disposed on the first edge 214 of the elongated arm 202, proximate the pivot 208 thereof. The deflection assembly 210 includes a biasing element, which in the example shown and described herein is a spring 222 having a first end 234 disposed within the first recess 218 of the elongated arm 202, and a second end 236 that engages a first side 224 of the deflection member 212 of the deflection assembly 210. The spring 220 is, therefore, structured to bias the deflection member 212 toward engagement with the reset lever 70 and, in particular, the second end 74 thereof, as shown in FIGS. 1, 2, 5, 6A and 6B. Hence, it will be appreciated that it is the deflection of the exemplary spring 222, which ultimately accommodates excess travel of the cradle assembly 50 (FIGS. 1, 2, 5, 6A and 6B), in the manner previously discussed.

The pivot 208 of the example elongated arm 202 is disposed at the second end 206 thereof, and includes a generally circular portion 238 including a hole 240, a pin member 242 extending through the hole 240 and pivotably coupling the elongated arm 202 to the side plate 104 (FIGS. 6A and 6B) of the circuit breaker housing 4 (FIGS. 1 and 2), and a protrusion 244. The protrusion 244 extends outwardly from the generally circular portion 238, and is generally parallel with respect to the first edge 214 of the elongated arm 202 and is spaced apart therefrom, as best shown in the side elevation view of FIG. 4. The generally planar member 212, which is the deflection member 212 of the example deflection assembly 210, in addition to the aforementioned first side 224, includes a second side 226, disposed opposite the first side 224, and first and second ends 228,230. The second end 230 is disposed between the protrusion 244 of the pivot 208 and the first edge 214 of the elongated arm 202. The first end 228 includes a tab 232 extending outwardly from the first side 224 of the generally planar member 212. The tab 232 movably engages the first edge 214 of the elongated arm 202 at or about the second recess 220 thereof, as best shown in hidden line drawing in FIGS. 6A and 6B. The protrusion 244 includes an aperture 246, as shown in FIGS. 3 and 5 in solid line drawing, and in hidden line drawing in FIGS. 6A and 6B. A fastener 248, which includes a first end 249, a second end 250, and a shaft 251 extending therebetween, extends through the aperture 246 of the protrusion 244, through the second end 230 of the generally planar member 212 of the deflection assembly 210, and into the first edge 214 of the elongated arm 202, in order that the first end 249 is disposed in the first edge 214, the second end 250 is disposed at or about the protrusion 244, and the shaft 251 extends therebetween, and as best shown in FIGS. 6A and 6B. Accordingly, it will be appreciated that the shaft 251 of the fastener 248 movably secures the second end 230 of the generally planar member 212 between the first edge 214 of the elongated arm 202 and the protrusion 244. The first end 228 of the generally planar member 212 and, in particular, the tab 232 thereof, is secured within the second recess 220 of the elongated arm 202. In this manner, the generally planar member 212, which is the deflection member 212 of the deflection assembly 210, can be deflected, for example, by the second end 74 of the reset lever 70 of the trip actuator reset assembly 50, such that the tab 232 of the deflection member 212 moves downwardly (from the perspective of FIG. 6B) within the second recess 220 of the elongated arm 202, and the second end 230 of the deflection member 212 slides downwardly (from the perspective of FIG. 6B) on the shaft 251 of the fastener 248, as shown in FIG. 6B.

As shown, for example, in FIG. 6A, the example lever arm assembly 200 also includes the aforementioned connecting link 252, although it will be appreciated that any known or suitable alternative number and/or configuration of linking elements (e.g., 202,252), as defined herein, could be employed, without departing from the scope of the invention. The example connecting link 252 includes a first end 254 pivotably coupled to a corresponding one 58 of the side members 58,60 of the cradle assembly 50, and a second end 256 pivotably coupled to the first end 204 of the elongated arm 202. Specifically, as best shown in FIG. 3, the first end 204 of the elongated arm 202 includes a pair of opposing side walls 260,262 (partially shown in hidden line drawing), which form a slot 264 (partially shown in hidden line drawing) therebetween. The second end 256 (shown in hidden line drawing) of the connecting link 252 is pivotably disposed within such slot 264, between the pair of opposing side walls 260,262, as shown. Accordingly, it will be appreciated that the connecting link 252 translates movement of the cradle assembly 52 to the elongated arm 202 and, in turn, to the reset lever 70, in order to reset the actuating element 130 of the trip actuator 102, as shown in FIG. 6B, following the trip condition. In the example shown and described herein, the pivotable connection between the first end 254 of the connecting link 252 and the first side 58 of the cradle assembly 52 is accomplished using a pin 258 (FIGS. 2-5, 6A and 6B), although it will be appreciated that any known or suitable alternative fastener or connecting mechanism (not shown) could be employed.

Accordingly, it will be appreciated that the disclosed trip actuator reset assembly 100 and lever arm assembly 200 therefor, provide a mechanism for accommodating, for example and without limitation, misalignment and/or overrotation associated therewith, in order to effectively, consistently reset the trip actuator 102 of the circuit breaker 2 (FIGS. 1 and 2).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A lever arm assembly for a trip actuator reset assembly of an electrical switching apparatus including a housing, separable contacts enclosed by said housing, and an operating mechanism structured to open and close said separable contacts, said operating mechanism including a pole shaft, said trip actuator reset assembly including a cradle assembly pivotably coupled to said pole shaft, a reset lever pivotably coupled to said housing, and a trip actuator including an actuating element, said cradle assembly being movable among a first position corresponding to said separable contacts being closed, and a second position corresponding to said separable contacts being open, said actuating element being structured to move said reset lever in response to a trip condition, said lever arm assembly comprising:

at least one linking element including a first end structured to be pivotably coupled to said cradle assembly, a second end disposed opposite and distal from the first end, and a pivot structured to pivotably couple said at least one linking element to said housing; and a deflection assembly comprising a deflection member disposed on a corresponding one of said at least one linking element and being structured to move said reset lever, wherein, after said trip condition, said actuating element of said trip actuator is structured to be reset, wherein, when said cradle assembly moves from said first position toward said second position, said cradle assembly moves said corresponding one of said at least one linking element, thereby moving said deflection member into engagement with said reset lever, in order to pivot said reset lever, wherein, when said deflection member pivots said reset lever, said reset lever moves said actuating element of said trip actuator, thereby resetting said trip actuator, and wherein, after said trip actuator has been reset, if said cradle assembly continues to move beyond said second position, then said deflection assembly deflects to accommodate any additional motion of said cradle assembly.

2. The lever arm assembly of claim 1 wherein said corresponding one of said at least one linking element comprises an elongated arm including a first end, a second end, a first edge, a second edge disposed opposite the first edge, a pivot disposed at or about the second end, and at least one recess disposed on the first edge proximate said pivot; and wherein said deflection assembly is coupled to the first edge at or about said at least one recess.

3. The lever arm assembly of claim 2 wherein said deflection assembly further comprises a bias element substantially disposed within a corresponding one of said at least one recess; and wherein said bias element is structured to bias said deflection member toward engagement with said reset lever.

4. The lever arm assembly of claim 3 wherein said at least one recess is a first recess and a second recess disposed on the first edge of said elongated arm proximate said first recess; wherein said deflection member is a generally planar member having a first side facing the first edge of said elongated arm, a second side disposed opposite the first side, a first end, a second end disposed opposite the first end of said generally planar member, and a tab extending outwardly from the first side of said generally planar member at or about the first end of said generally planar member; wherein the second end of said generally planar member is structured to cooperate with said pivot; and wherein said tab movably engages the first edge of said elongated arm at or about said second recess.

5. The lever arm assembly of claim 4 wherein said bias element is a spring having a first end and a second end disposed opposite and distal from the first end of said spring; and wherein the first end of said spring is disposed in said first recess and the second end of said spring engages the first side of said generally planar member.

6. The lever arm assembly of claim 4 wherein said pivot comprises a generally circular portion disposed at or about the second end of said elongated arm, said generally circular portion including a hole, a pin member extending through said hole and being structured to be pivotably coupled to said housing of said electrical switching apparatus, and a protrusion extending outwardly from said generally circular portion; wherein said protrusion is generally parallel with respect to the first edge of said elongated arm and is spaced apart from the first edge of said elongated arm; and wherein the second end of said generally planar member is disposed between said protrusion and the first edge of said elongated arm.

7. The lever arm assembly of claim 6 wherein said protrusion includes an aperture; wherein said deflection assembly further comprises a fastener including a first end, a second end, and a shaft extending therebetween; wherein said fastener extends through said aperture of said protrusion, through the second end of said generally planar member, and into the first edge of said elongated arm, in order that the first end of said fastener is disposed in the first edge of said elongated arm, the second end of said fastener is disposed at or about said protrusion, and said shaft of said fastener extends between said protrusion and the first edge of said elongated arm; and wherein said shaft movably secures the second end of said generally planar member between the first edge of said elongated arm and said protrusion.

8. The lever arm assembly of claim 2 wherein said cradle assembly includes a first end pivotably coupled to said pole shaft, a second end disposed opposite and distal from the first end of said cradle assembly, and at least one side member extending between the first end of said cradle assembly and the second end of said cradle assembly; wherein said at least one linking element further comprises a connecting link structured to interconnect said elongated arm and said cradle assembly; and wherein said connecting link includes a first end structured to be pivotably coupled to a corresponding one of said at least one side member, and a second end pivotably coupled to the first end of said elongated arm.

9. The lever arm assembly of claim 8 wherein the first end of said elongated arm comprises a pair of opposing side walls forming a slot therebetween; and wherein the second end of said connecting link is pivotably disposed within said slot between said pair of opposing side walls.

10. A trip actuator reset assembly for an electrical switching apparatus including a housing, separable contacts enclosed by said housing, and an operating mechanism structured to open and close said separable contacts, said operating mechanism including a pole shaft, said trip actuator reset assembly comprising:

a cradle assembly including a first end structured to be pivotably coupled to said pole shaft, a second end disposed opposite and distal from the first end, and at least one side member extending between the first end and the second end, said cradle assembly being movable among a first position corresponding to said separable contacts being closed, and a second position corresponding to said separable contacts being open;

a reset lever structured to be pivotably coupled to said housing;

a trip actuator including an actuating element which, in response to a trip condition, moves said reset lever; and a lever arm assembly comprising:

at least one linking element including a first end pivotably coupled to a corresponding one of said at least one side member of said cradle assembly, a second end disposed opposite and distal from the first end of said at least one linking element, and a pivot structured to pivotably couple said at least one linking element to said housing, and a deflection assembly comprising a deflection member disposed on a corresponding one of said at least one linking element and being cooperable with said reset lever, wherein, after said trip condition, said actuating element of said trip actuator must be reset, wherein, when said cradle assembly moves from said first position toward said second position, said at least one side member of said cradle assembly moves said corresponding one of said at least one linking element, thereby moving said deflection member into engagement with said reset lever, in order to pivot said reset lever, wherein, when said deflection member pivots said reset lever, said reset lever moves said actuating element of said trip actuator, thereby resetting said trip actuator, and wherein, after said trip actuator has been reset, if said cradle assembly continues to move beyond said second position, then said deflection assembly deflects to accommodate any additional motion of said cradle assembly.

11. The trip actuator reset assembly of claim 10 wherein said corresponding one of said at least one linking element of said lever arm assembly comprises an elongated arm including a first end, a second end, a first edge, a second edge disposed opposite the first edge, a pivot disposed at or about the second end of said elongated arm, and at least one recess disposed on the first edge proximate said pivot of said elongated arm; wherein said deflection member of said deflection assembly is coupled to the first edge of said elongated arm at or about said at least one recess; wherein said deflection assembly further comprises a bias element substantially disposed within a corresponding one of said at least one recess; and wherein said bias element biases said deflection member toward engagement with said reset lever.

12. The trip actuator reset assembly of claim 11 wherein said at least one recess is a first recess and a second recess disposed on the first edge of said elongated arm proximate said first recess; wherein said deflection member of said deflection assembly is a generally planar member having a first side facing the first edge of said elongated arm, a second side disposed opposite the first side of said generally planar member, a first end, a second end disposed opposite the first end of said generally planar member, and a tab extending outwardly from the first side of said generally planar member at or about the first end of said generally planar member; wherein said tab movably engages the first edge of said elongated arm at or about said second recess; wherein said bias element is a spring disposed in said first recess between the first edge of said elongated arm and the first side of said generally planar member; wherein said pivot of said elongated arm comprises a generally circular portion disposed at or about the second end of said elongated arm, said generally circular portion including a hole, a pin member extending through said hole and being structured to be pivotably coupled to said housing of said electrical switching apparatus, and a protrusion extending outwardly from said generally circular portion; wherein said protrusion is generally parallel with respect to the first edge of said elongated arm and is spaced apart from the first edge of said elongated arm; and wherein the second end of said generally planar member is disposed between said protrusion and the first edge of said elongated arm.

13. The trip actuator reset assembly of claim 11 wherein said at least one linking element of said lever assembly further comprises a connecting link interconnecting said elongated arm and said cradle assembly; and wherein said connecting link includes a first end pivotably coupled to said corresponding one of said at least one side member of said cradle assembly, and a second end pivotably coupled to the first end of said elongated arm.

14. The trip actuator reset assembly of claim 10 wherein said housing of said electrical switching apparatus includes a mounting surface and at least one side plate extending outwardly from said mounting surface; wherein said at least one side plate includes a first side, a second side opposite said first side of said at least one side plate, and an opening extending through said at least one side plate; wherein said actuating element of said trip actuator is structured to be disposed on the first side of said at least one side plate; wherein said cradle assembly is structured to be disposed on the second side of said at least one side plate; wherein said pivot of said at least one linking element of said lever arm assembly is structured to be pivotably coupled to the second side of said at least one side plate; wherein said reset lever includes a first end overlaying said actuating element, a second end disposed distal from the first end of said reset lever, and a pivot structured to pivotably couple said reset lever to the first side of said at least one side plate; and wherein the second end of said reset lever is structured to extend from at or about the first side of said at least one side plate, through said opening of said at least one side plate, and beyond the second side of said at least one side plate, in order to overlay said deflection member of said deflection assembly of said lever arm assembly.

15. The trip actuator reset assembly of claim 14 wherein, when said cradle assembly is moved toward said second position, said deflection member of said deflection assembly of said lever arm assembly engages and moves the second end of said reset lever, in order that said reset lever pivots about said pivot of said reset lever and the first end of said reset lever resets said actuating element of said trip actuator; and wherein, after said trip actuator is reset, if said cradle assembly continues to move, then said deflection member of said deflection assembly of said lever arm assembly deflects in order to absorb such movement.

16. The trip actuator reset assembly of claim 14 wherein said reset lever further includes a bias member; and wherein said bias member is structured to be disposed within said opening of said at least one side plate, in order to bias the second end of said reset lever away from said actuating element of said trip actuator.

17. An electrical switching apparatus comprising:

a housing;

separable contacts enclosed by said housing;

an operating mechanism structured to open and close said separable contacts, said operating mechanism including a pole shaft; and a trip actuator reset assembly comprising:

a cradle assembly including a first end pivotably coupled to said pole shaft, a second end disposed opposite and distal from the first end, and at least one side member extending between the first end and the second end, said cradle assembly being movable among a first position corresponding to said separable contacts being closed, and a second position corresponding to said separable contacts being open, a reset lever pivotably coupled to said housing, a trip actuator including an actuating element which, in response to a trip condition, moves said reset lever, and a lever arm assembly comprising:

at least one linking element including a first end pivotably coupled to said corresponding one of said at least one side member of said cradle assembly, a second end disposed opposite and distal from the first end of said at least one linking element, and a pivot pivotably coupling said at least one linking element to said housing, and a deflection assembly comprising a deflection member disposed on a corresponding one of said at least one linking element and being cooperable with said reset lever, wherein, after said trip condition, said actuating element of said trip actuator must be reset, wherein, when said cradle assembly moves from said first position toward said second position, said corresponding one of said at least one side member of said cradle assembly moves said corresponding one of said at least one linking element, thereby moving said deflection member into engagement with said reset lever, in order to pivot said reset lever, wherein, when said deflection member pivots said reset lever, said reset lever moves said actuating element of said trip actuator, thereby resetting said trip actuator, and wherein, after said trip actuator has been reset, if said cradle assembly continues to move beyond said second position, then said deflection assembly deflects to accommodate any additional motion of said cradle assembly.

18. The electrical switching apparatus of claim 17 wherein said corresponding one of said at least one linking element of said lever arm assembly of said trip actuator reset assembly comprises an elongated arm including a first end, a second end, a first edge, a second edge disposed opposite the first edge, a pivot disposed at or about the second end of said elongated arm, and at least one recess disposed on the first edge proximate said pivot of said elongated arm; wherein said deflection member of said deflection assembly is coupled to the first edge of said elongated arm at or about said at least one recess; wherein said deflection assembly further comprises a bias element substantially disposed within a corresponding one of said at least one recess; and wherein said bias element biases said deflection member toward engagement with said reset lever.

19. The electrical switching apparatus of claim 18 wherein said at least one recess is a first recess and a second recess disposed on the first edge of said elongated arm proximate said first recess; wherein said deflection member of said deflection assembly is a generally planar member having a first side facing the first edge of said elongated arm, a second side disposed opposite the first side of said generally planar member, a first end, a second end disposed opposite the first end of said generally planar member, and a tab extending outwardly from the first side of said generally planar member at or about the first end of said generally planar member; wherein said tab movably engages the first edge of said elongated arm at or about said second recess; wherein said bias element is a spring disposed in said first recess between the first edge of said elongated arm and the first side of said generally planar member; wherein said pivot of said elongated arm comprises a generally circular portion disposed at or about the second end of said elongated arm, said generally circular portion including a hole, a pin member extending through said hole and being structured to be pivotably coupled to said housing of said electrical switching apparatus, and a protrusion extending outwardly from said generally circular portion; wherein said protrusion is generally parallel with respect to the first edge of said elongated arm and is spaced apart from the first edge of said elongated arm; and wherein the second end of said generally planar member is disposed between said protrusion and the first edge of said elongated arm.

20. The electrical switching apparatus of claim 18 wherein said at least one linking element of said lever assembly further comprises a connecting link interconnecting said elongated arm and said cradle assembly; and wherein said connecting link includes a first end pivotably coupled to said corresponding one of said at least one side member of said cradle assembly, and a second end pivotably coupled to the first end of said elongated arm.

21. The electrical switching apparatus of claim 17 wherein said housing of said electrical switching apparatus includes a mounting surface and at least one side plate extending outwardly from said mounting surface; wherein said at least one side plate includes a first side, a second side opposite said first side of said at least one side plate, and an opening extending through said at least one side plate; wherein said actuating element of said trip actuator is disposed on the first side of said at least one side plate; wherein said cradle assembly is disposed on the second side of said at least one side plate; wherein said pivot of said at least one linking element of said lever arm assembly is pivotably coupled to the second side of said at least one side plate; wherein said reset lever includes a first end overlaying said actuating element, a second end disposed distal from the first end of said reset lever, and a pivot pivotably coupling said reset lever to the first side of said at least one side plate; and wherein the second end of said reset lever extends from at or about the first side of said at least one side plate, through said opening of said at least one side plate, and beyond the second side of said at least one side plate, in order to overlay said deflection member of said deflection assembly of said lever arm assembly.

22. The electrical switching apparatus of claim 21 wherein said reset lever of said trip actuator reset assembly further includes a bias member disposed within said opening of said at least one side plate; wherein said bias member biases the second end of said reset lever away from said actuating element of said trip actuator; wherein, when said cradle assembly is moved toward said second position, said deflection member of said deflection assembly of said lever arm assembly engages and moves the second end of said reset lever, in order that said reset lever pivots about said pivot of said reset lever and the first end of said reset lever resets said actuating element of said trip actuator; and wherein, after said trip actuator is reset, if said cradle assembly continues to move, then said deflection member of said deflection assembly of said lever arm assembly deflects in order to absorb such movement.

23. The electrical switching apparatus of claim 21 wherein said electrical switching apparatus is a circuit breaker; wherein said at least one side plate of said housing of said circuit breaker is a first side plate and a second side plate disposed opposite and spaced apart from said first side plate; wherein said cradle assembly is disposed between said first side plate and said second side plate; wherein said actuating element of said trip actuator is a plunger; wherein, in response to said trip condition, said plunger extends in order to move said reset lever; wherein, after said trip condition, said plunger remains extended until it is depressed by said reset lever, in order to reset said trip actuator; wherein, when said cradle assembly is moved toward said second position, said deflection member of said deflection assembly of said lever arm assembly engages the second end of said reset lever, thereby pivoting said reset lever; wherein, as said cradle assembly moves into said second position, said reset lever continues to pivot until the first end of said reset lever completely depresses said plunger, thereby resetting said trip actuator; and wherein, after said trip actuator is reset, if said cradle assembly continues to move, then said deflection member of said deflection assembly deflects to absorb such movement.

* * * * *